US009562402B2

(12) United States Patent
Vu

(10) Patent No.: US 9,562,402 B2
(45) Date of Patent: Feb. 7, 2017

(54) SHUNT TUBE CONNECTOR ASSEMBLY AND METHOD

(71) Applicant: Phong Vu, Houston, TX (US)

(72) Inventor: Phong Vu, Houston, TX (US)

(73) Assignee: Delta Screen & Filtration, LLC, Houston, TX (US)

( * ) Notice: Subject to any disclaimer, the term of this patent is extended or adjusted under 35 U.S.C. 154(b) by 138 days.

(21) Appl. No.: 14/628,386

(22) Filed: Feb. 23, 2015

(65) Prior Publication Data

US 2015/0240572 A1 Aug. 27, 2015

Related U.S. Application Data

(60) Provisional application No. 61/943,814, filed on Feb. 24, 2014.

(51) Int. Cl.

| | |
|---|---|
| ***E21B 17/046*** | (2006.01) |
| ***E21B 17/18*** | (2006.01) |
| ***E21B 19/16*** | (2006.01) |
| ***E21B 43/08*** | (2006.01) |

(52) U.S. Cl.

CPC ..... *E21B 17/18* (2013.01); *E21B 17/046* (2013.01); *E21B 19/16* (2013.01); *E21B 43/08* (2013.01)

(58) Field of Classification Search

CPC ..... E21B 43/04; E21B 43/08; E21B 17/02; E21B 17/18; E21B 17/046; E21B 19/16; E21B 43/103; E21B 43/10; E21B 43/12

See application file for complete search history.

(56) References Cited

U.S. PATENT DOCUMENTS

| | | | |
|---|---|---|---|
| 3,282,301 | A | 11/1966 | Ligon |
| 4,945,991 | A | 8/1990 | Jones |
| 5,419,394 | A | 5/1995 | Jones |
| 5,842,516 | A | 12/1998 | Jones |

(Continued)

FOREIGN PATENT DOCUMENTS

WO 2013187878 A1 12/2013

OTHER PUBLICATIONS

International Search Report, May 29, 2015.
ISA Written Opinion, May 29, 2015.

*Primary Examiner* — Daniel P Stephenson
(74) *Attorney, Agent, or Firm* — Keeling Law, LLC; Kenneth A. Keeling; Mark S. Solomon

(57) ABSTRACT

Embodiments of a shunt tube connector assembly generally include a jumper tube assembly and a cooperative shroud assembly. In one embodiment, the jumper tube assembly includes a jumper tube having two tube connectors slideable thereon, where the tube connectors are fluidly connectable to shunt tubes. In one embodiment, the shroud assembly includes shroud segments, and corresponding shroud connection collars that include openings for shunt tubes and a transverse dove tail in the surface thereof, where shroud segments have a dove pin extending inwardly therefrom and adapted to engage a collar dove tail. Embodiments of a method for connecting and shrouding connectable pipe segments equipped with exterior shunt tubes generally include providing fluidly connected pipe segments having collars comprising an exterior surface opened dove tail, fluidly connecting shunt tubes, and attaching shroud segments around at least a portion of each said pipe segment by engaging a dove pin with the dovetail.

20 Claims, 8 Drawing Sheets

(56) References Cited

U.S. PATENT DOCUMENTS 6,848,510 B2 * 2/2005 Bixenman ..... E21B 43/04 166/227
7,373,989 B2 5/2008 Setterberg, Jr.
7,493,959 B2 * 2/2009 Johnson ..... E21B 17/02 166/242.6
7,497,267 B2 3/2009 Setterberg, Jr. et al.
7,597,141 B2 10/2009 Rouse et al.
7,828,056 B2 11/2010 Dybevik et al.
7,886,819 B2 2/2011 Setterberg, Jr. et al.
8,893,789 B2 * 11/2014 Cunningham ..... E21B 43/04 166/242.3
9,260,953 B2 * 2/2016 Cunningham ..... E21B 43/04
9,322,248 B2 * 4/2016 Yeh ..... E21B 33/124
2002/0053439 A1 * 5/2002 Danos ..... E21B 17/1035 166/380
2002/0092649 A1 * 7/2002 Bixenman ..... E21B 43/04 166/278
2002/0174984 A1 * 11/2002 Jones ..... E21B 43/08 166/278
2004/0140089 A1 * 7/2004 Gunneroed ..... E21B 34/06 166/228
2005/0082060 A1 * 4/2005 Ward ..... E21B 43/045 166/278
2005/0205269 A1 * 9/2005 Kilgore ..... E21B 23/06 166/387
2010/0096119 A1 4/2010 Sevre et al.
2010/0139919 A1 6/2010 Yeh et al.
2012/0048536 A1 * 3/2012 Holderman ..... B23P 11/025 166/228
2013/0220606 A1 8/2013 Yhuel et al.
2013/0327542 A1 * 12/2013 Least ..... E21B 17/02 166/380
2014/0027115 A1 1/2014 Sanders
2015/0240572 A1 * 8/2015 Vu ..... E21B 43/08 166/380

* cited by examiner

Method 200

SHUNT TUBE CONNECTOR ASSEMBLY AND METHOD

CROSS-REFERENCE TO RELATED APPLICATIONS

This application claims the benefit of U.S. Provisional Application No. 61/943,814 filed on Feb. 24, 2014, which application is incorporated herein by reference as if reproduced in full below.

STATEMENT REGARDING FEDERALLY SPONSORED RESEARCH OR DEVELOPMENT

Not applicable.

FIELD OF THE INVENTION

The present invention relates generally to systems and methods of controlling fluid flow in a well bore. More specifically, the present invention addresses a system and method of connecting and protecting shunt tubes used in drilling operations.

BACKGROUND

Down-hole drilling operations commonly require filter screens to restrain flow of sand and particulates existing in the well environment from entering pipe openings. In a common application, shunt tubes are utilized exterior of a base pipe to provide fluid communication downhole independent of flow through a base pipe.

As presently practiced, jumper tubes are provided at connections of the base pipe sections. Jumper tubes provide fluid connection of a shunt tube on a pipe section to a corresponding shunt tube attached to an abutting pipe section. Jumper tubes are installed after connection of pipe sections.

Generally, for adjoining pipe sections, shunt tube ends are aligned when pipe sections are connected. The jumper tube is inserted between respective shunt tube ends. The jumper tube has a connector at each end comprising a telescoping tube section slideable on the jumper tube. Each telescoping tube section is extended to cover a corresponding shunt tube end. Seals are provided intermediate the telescoping sections and corresponding jumper tube sections, and intermediate telescoping sections and corresponding shunt tube ends to provide a contained fluid flow path from a shunt tube through a jumper tube to the next corresponding shunt tube. Set screws are used to retain a telescoping tube section to a corresponding shunt tube end and to retain a telescoping tube end to a corresponding jumper tube.

Split covers are used to encase the jumper tube assemblies for protection downhole. As commercially practiced, split covers comprise a tubular assembly cut longitudinally into two sections. Split covers are hinged along one pair of adjoining edges to allow the cover to open and close longitudinally. After connection of jumper tubes, split covers are positioned external of the pipe joint and jumper tubes, and closed to provide a concentric cover and attached at abutting edges distal the hinge with screws or locking bolts.

Exemplary shunt tube systems are described in, among others, U.S. Pat. No. 4,945,991 to Jones, U.S. Pat. No. 5,419,394 to Jones, U.S. Pat. No. 5,842,516 to Jones, U.S. Pat. No. 7,373,989 to Setterberg, Jr., U.S. Pat. No. 7,828,056 to Dybevik, et al., and U.S. Pat. No. 7,957,141 to Rouse, et al.

Exemplary jumper tube connectors are described in U.S. Pat. No. 7,497,267 to Setterberg, Jr. and U.S. Pat. No. 7,886,819 to Setterberg, Jr.

BRIEF SUMMARY OF THE INVENTION

Embodiments of the present invention comprise a shunt tube connector assembly including a jumper tube assembly and a cooperative shroud assembly. In one embodiment, the jumper assembly comprises a jumper tube having two connectors, the connectors slideable on the jumper tube, and the shroud assembly comprises two half-cylinder shroud segments and corresponding shroud connection collars/end rings. In one embodiment, each shroud collar comprises a cylindrical ring having axial openings in the collar external surface and further having a dove tail extending circumferentially around the collar external surface, and each shroud section has a dove pin extending inwardly from the shroud segment. In one embodiment, each dove pin is sized and structured in relation to a corresponding collar dove tail to be slideably received therein, and each dove pin has a lateral dimension sized and structured to allow the dove pin to extend through a corresponding collar circumferential opening. In an installed embodiment, an upper dove pin is received in a dove tail of a collar attached to an upper pipe section and a lower dove pin is received in a lower dove tail of a lower collar attached to a lower pipe section.

BRIEF DESCRIPTION OF THE DRAWINGS

For a more complete understanding of the exemplary embodiments, reference is now made to the following Description of Exemplary Embodiments of the Invention, taken in conjunction with the accompanying drawings, in which.

DESCRIPTION OF EXEMPLARY EMBODIMENTS OF THE INVENTION

Figure 1:
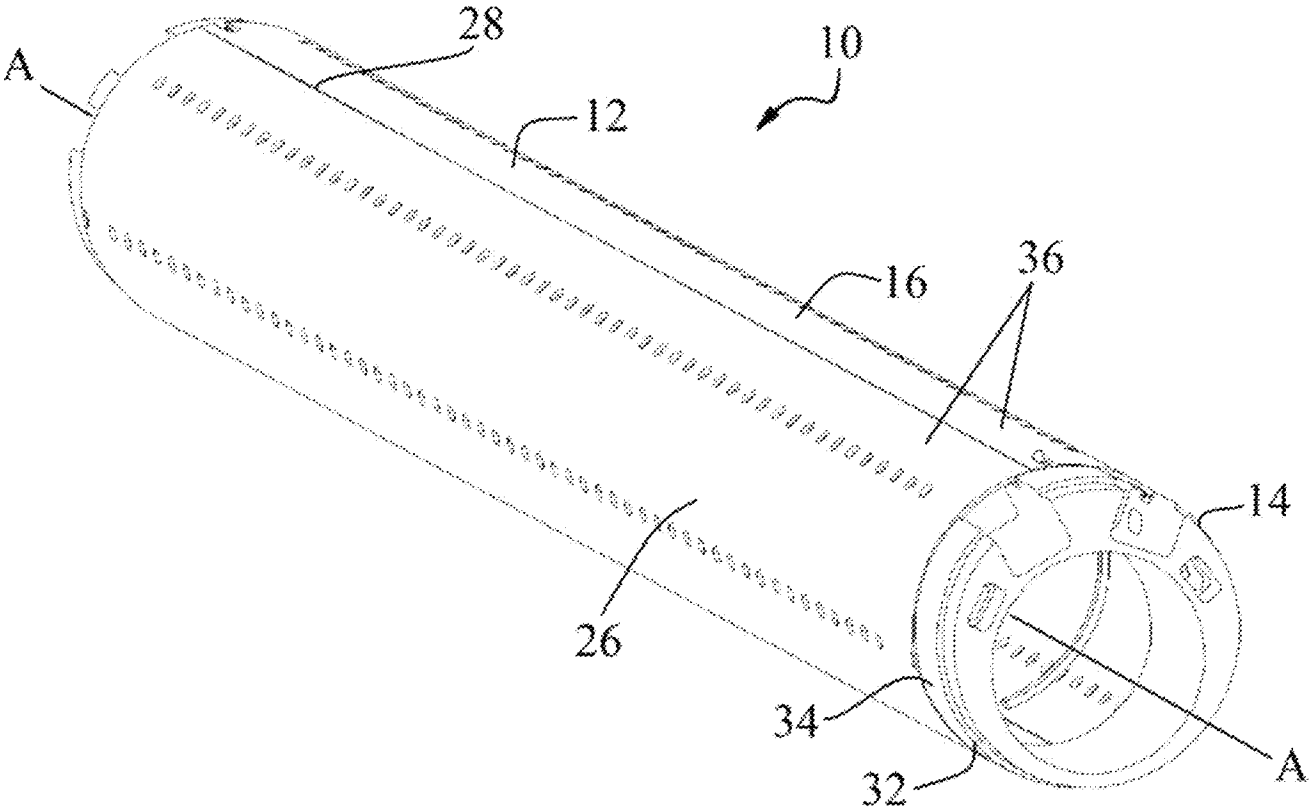
FIG. 1 depicts a view of a shroud assembly of an embodiment of the present invention.

The exemplary embodiments are best understood by referring to the drawings with like numerals being used for like and corresponding parts of the various drawings. As used herein longitudinal refers to the axis A-A identified in FIG. 1 and transverse refers to a direction normal to axis A-A of FIG. 1.

Figure 6:
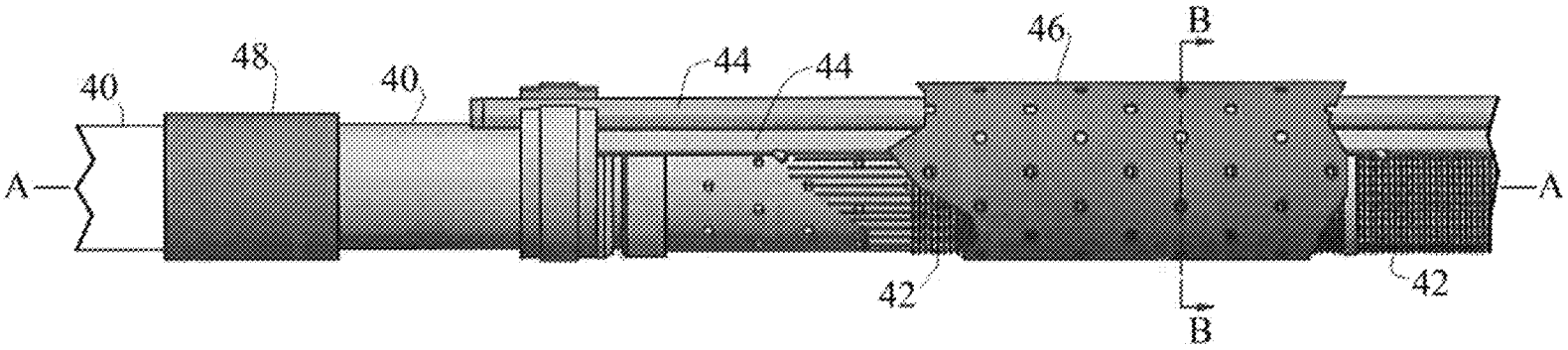
Figure 6 (Prior Art)
FIG. 6 depicts a prior art pipe with wire screen, shunt tube assembly, and shroud.
Figure 8:
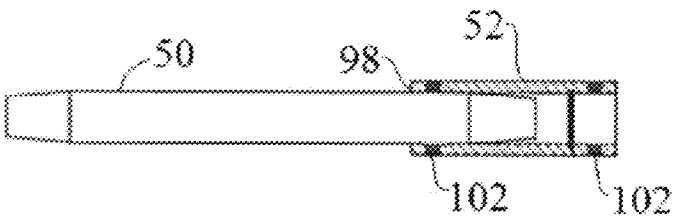
Figure 8 (Prior Art)
FIG. 8 depicts a prior art jumper tube with connector.
Figure 7:
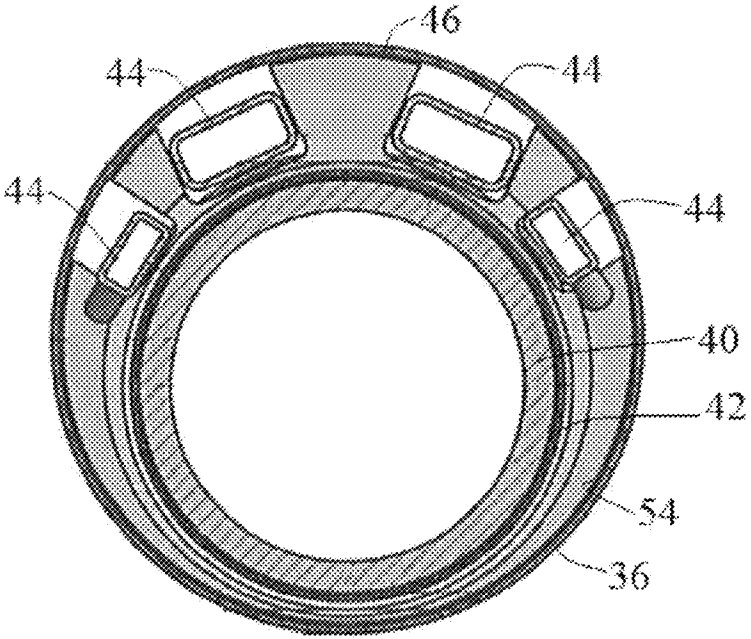
Figure 7 (Prior Art)
FIG. 7 depicts a cross-section at B-B of FIG. 6.

Referring first to FIG. 6, a partial cut-away view of exemplary pipe sections 40 with wire screen 42, shunt tubes 44, and shroud 46 is depicted for reference. Pipes 40 are connected at typical pipe joint 48. Referring to FIG. 7, a cross-sectional view of FIG. 6 at B-B is depicted. Referring to FIG. 8, a commercially practiced jumper tube 50 with jumper tube connector 52 is depicted. With respect to the teachings of the present disclosure, the disclosures of FIGS. 6, 7, and 8 in and of themselves are considered prior art and are provided for reference with respect to teachings of the present invention.

Referring to the embodiment of FIG. 1, a jumper shroud 12 and a proximal annular collar (end ring) 14 of the shroud assembly 10 of the present invention are disclosed. In this and other embodiments, a distal collar 14 (now shown) may be provided. Referring to the embodiment of FIG. 2, a partial view of the proximal end of jumper shroud 12, depicting shroud segments 16 and 26, interface there between 28, dove pins 20, a spring lock 18, spring lock channel 24, and a jumper connector retainer ring 22, of the shroud assembly 10 of the present invention, is provided.

Figure 3:
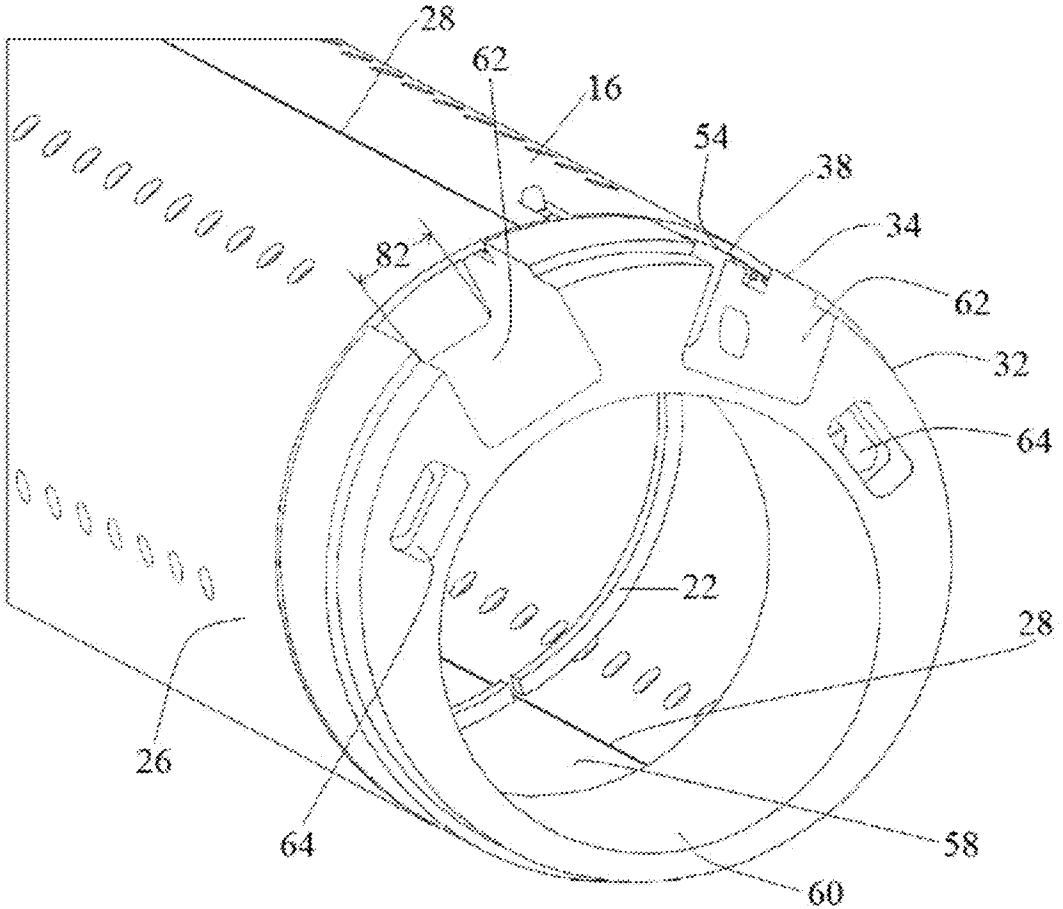
FIG. 3 depicts a detail view of a portion of a shroud assembly of an embodiment of the present invention.

Referring to the embodiment of FIG. 3, proximal collar 14 comprises external surface 32 and is generally cylindrical. In the embodiments shown in the Figures, collar 14 is depicted a single component; however, as one skilled in the art would understand, collar 14 may comprise a combination of various integrated sub-components. External surface 32 has an axially central section 34 externally sized to be substantially equivalent to the diameter of the external surface 36 of shroud 12. Inset shoulder 38 is provided on collar 14 to receive and connect to interior surface end 54 of shroud 12. Collar inset shoulder 38 is provided on collar 14 opposite shoulder 38 to connect with interior surface 58 of a jumper shroud segment 16 or 26 of jumper shroud 12. In one embodiment, jumper shroud 12 comprises two jumper shroud segments; however, the present invention is not so limited and in other embodiments jumper shroud 12 may comprise three or more jumper shroud segments. In the exemplary embodiment shown, shroud segments 16 and 12 are depicted as being substantially arc shaped; however, the present invention is not so limited and other geometries are contemplated. Collar 14 has a pipe opening 60 to receive pipe 40 (only shown in FIG. 6). Collar 14 has collar shunt tube openings 62 to receive various shunt tubes 44*a*. In the exemplary embodiment depicted, shunt tube openings 64 are also provided to receive shunt tubes 44*b*. Shunt tubes may be referred to generally herein as shunt tube 44 or collectively as shunt tubes 44. Shunt tube openings 64 differ from shunt tube openings 62 in that the openings 64 do not extend to collar external surface 32. Pipe opening 60 is positioned to align with pipe 40. In the exemplary embodiment depicted, the pipe 40 and shunt tubes 44*a*, 44*b* are described as eccentric as the pipe 40 is offset from the axial center of shroud 12.

Figure 4A:
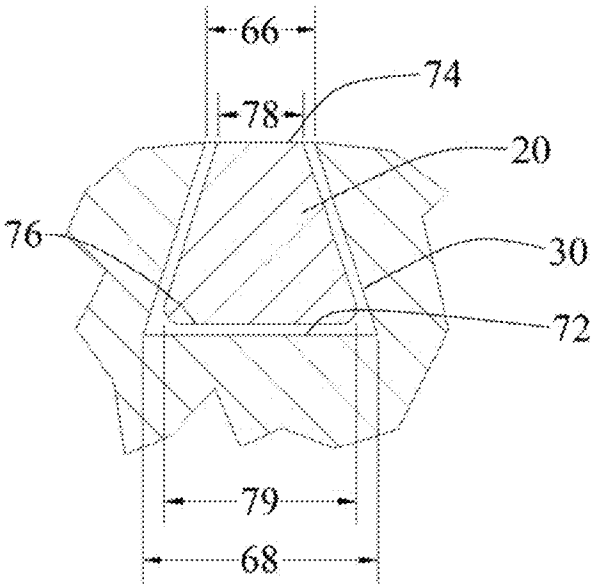
FIG. 4A depicts a detail view of a collar dove tail and shroud dove pin of an embodiment of the present invention.
Figure 4:
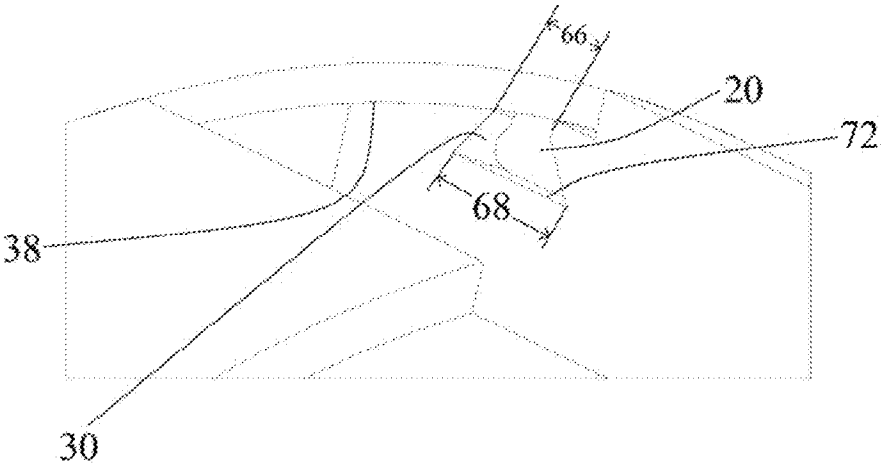
FIG. 4 depicts a detail view of collar dove tail and a portion of a shroud dove pin of an embodiment of the present invention.

Referring to the embodiments of FIGS. 4 and 4*a*, a detail of a dove tail (groove) 30 with a dove pin (tenon) 20 is depicted. Referring to the embodiment depicted in FIGS. 3 and 4, dove tail 30 is provided in the circumference of inset shoulder 38 of collar 14. Dove tail 30 has a collar surface opening width 66. Dove tail 30 has a largest internal opening width 68 that is greater than collar surface opening width 66. In the embodiment depicted, dove tail 30 is polygonal with its largest internal width 68 at its base 72.

Dove pin 20 extends inwardly from interior surface 58 of jumper shroud segment 16. A like dove pin 20 extends inwardly from interior surface 58 of jumper shroud segment 26. Each dove pin 20 has a base 74 proximate interior surface 58 and an extended width segment 76 distal interior surface 58. A width 78 of base 74 is less than collar surface opening width 66. A width 79 of extended width segment 76 of each dove pin 20 is greater than collar surface opening width 66 and less than largest internal width 68 of dove tail 30. Accordingly, dove pin 20, when installed, is retained within dove tail 30. Dimensions of collar surface opening width 66, largest internal width 68, base width 78, and extended width segment 76 are sufficiently loose to allow sliding arrangement of dove pin 20 within dove tail 30.

Figure 2:
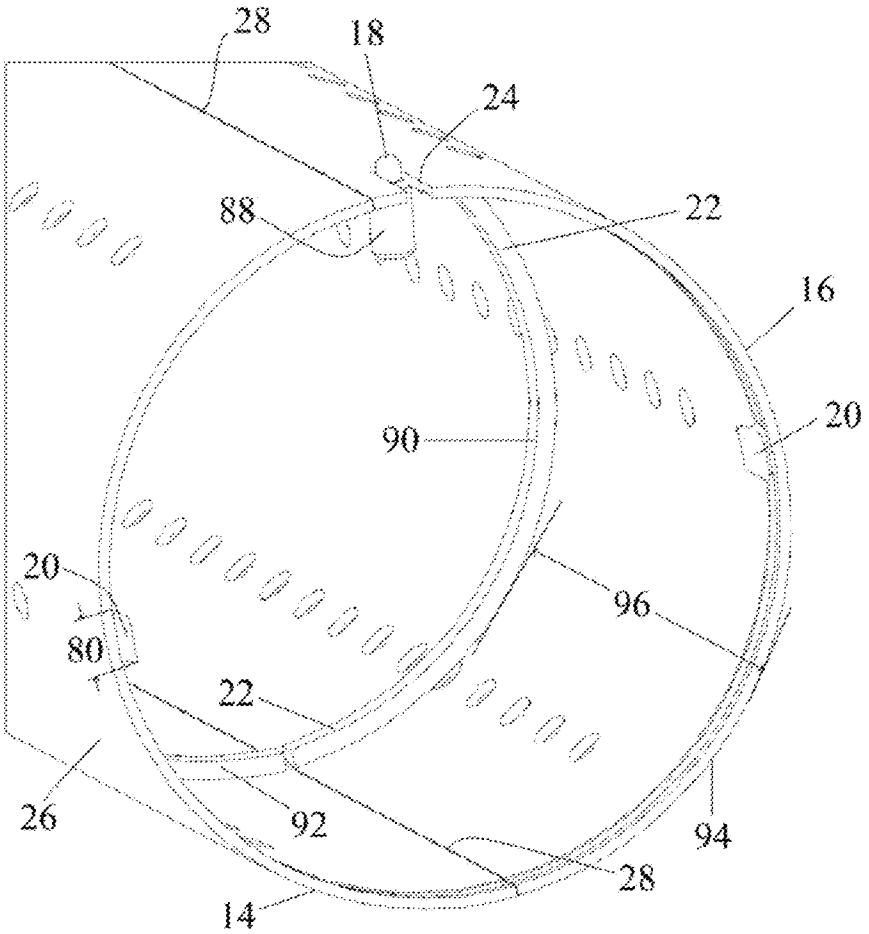
FIG. 2 depicts a view of a jumper shroud of an embodiment of the present invention.

Referring to the embodiments of FIGS. 2 and 3, each dove pin 20 has a transverse width 80 that is less than the lateral width 82 of at least one collar surface opening 62. Each shroud segment 16 and 26 is constructed so that interior surface 58 of each shroud segment 16 and 26 may be juxtaposed against collar shoulder 38 such that dove pin 20 and dove tail 30 are aligned. To attach a shroud segment 16 or 26 to a collar shoulder 38, the shroud segment 16 or 26 is positioned so that dove pin 20 is initially positioned at a collar surface opening 62. Shroud segment 16 or 26 may then be rotated in relation to collar 14 (i.e., angularly about axis A-A) to engage dove pin 20 in dove tail 30. Upon installation and rotation of the first of a shroud segment 16 or 26, the second of shroud segment 16 or 26 (and any additional shroud segments) may be accordingly installed. While FIG. 2 depicts dove pins 20 of shroud segments 16 and 26 proximate shroud segment end 94, in additional embodiments, shroud segments 16 and 26 may additionally comprise dove pins 20 proximate a distal end thereof. In addition, although the embodiment shown in FIG. 2 depicts each shroud segment 16 and 26 as comprising a proximal dove pin 20, in other embodiments one or more shroud segments may comprise a distal dove pin 20 in lieu of a proximal dove pin 20. In one embodiment, shroud segments 16 and 26 comprise one or more interface connection mechanisms (now shown) adapted to reversibly connect shroud segments 16 and 26 at the interface 28 there between. In further embodiments, such as, for example, wherein two or more shroud segments may be connectable by an interface connection mechanism, one or more shroud segments may not comprise a dove pin 20.

Figure 5:
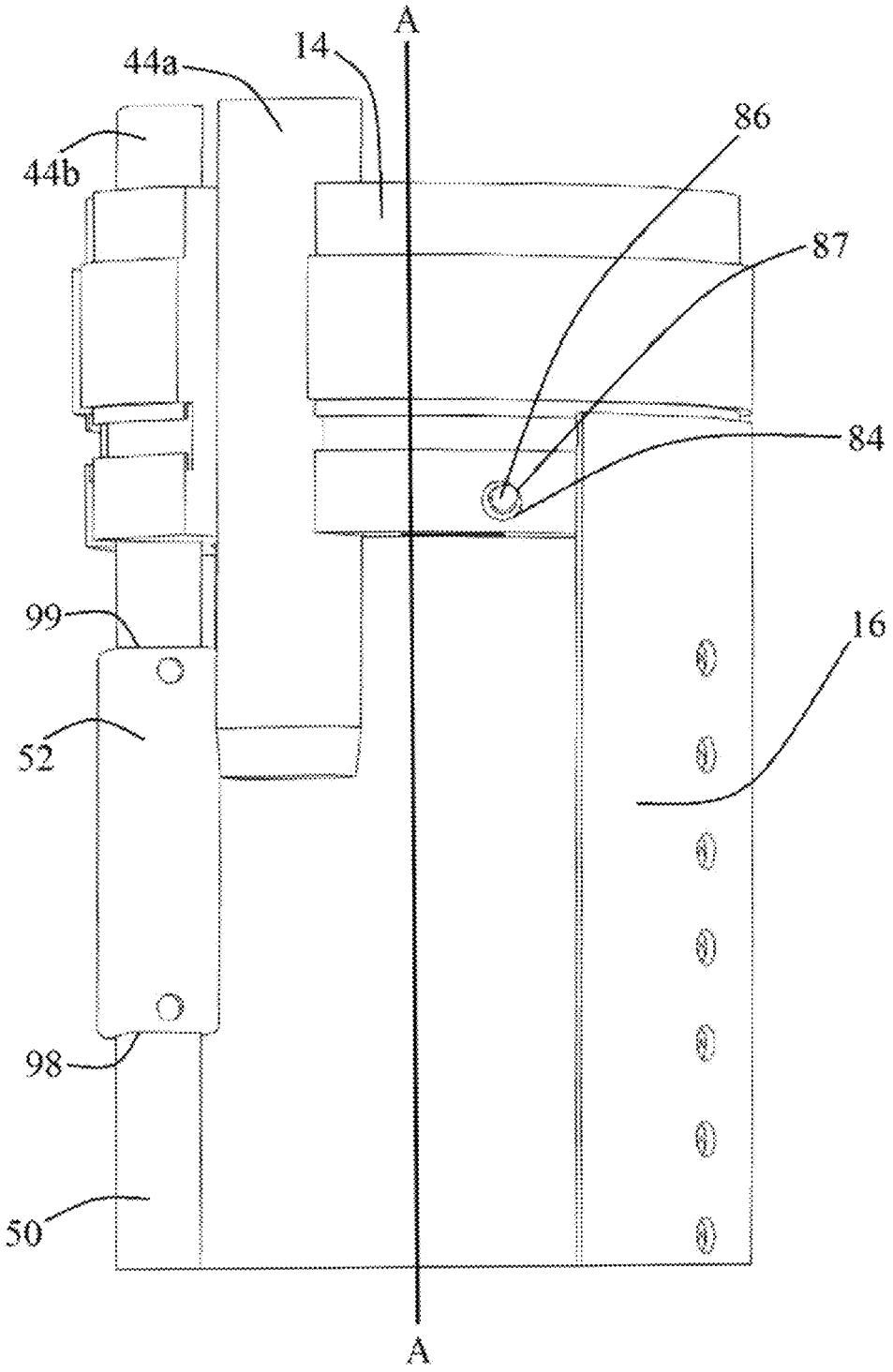
FIG. 5 depicts a partially assembled shroud assembly and a portion of a jumper tube assembly of an embodiment of the present invention.

Referring to the embodiment of FIG. 5, a locking mechanism, such as a spring lock 18, is provided in collar shoulder 38. Spring lock 18 comprises a spring receiver opening 84 in collar 14, a spring 88 (not shown in FIG. 5) and a spring pin 86. Pin 86 is normally biased outward from shoulder 38. Pin 86 has a rounded engagement end 87. A spring lock channel 24 or any useful mechanism for engaging pin 86 is provided in at least one of shroud segment 16 or shroud segment 26 and sized and positioned to receive pin 86. In operation, pin 86 may be pushed inwardly as a shroud segment 16 or shroud segment 26 is rotated. When shroud segment 16 or shroud segment 26 is rotated to an engagement position, pin 86 is biased outward into spring lock channel 24, thereby preventing further rotation of shroud segment 16 or shroud segment 26. Spring 88 is shown in FIG. 2 for illustration purposes independent of shoulder 38 and collar 14.

Referring to FIG. 5, an installed shroud segment 16 is depicted as installed in relation to collar 14 and dove tail 30. Two shunt tubes 44 are depicted in FIG. 5. At the stage of the shrouding process depicted in FIG. 5, one shunt tube 44*b* is connected to jumper tube 50 by means of sliding jumper tube connector 52, and one shunt tube 44*a* is unconnected.

Referring to FIGS. 2 and 3, retainer ring 22 is depicted. In one embodiment, retainer ring 22, comprising retainer ring segments 90 and 92, extends internally from interior surface 58 of jumper shroud 12. In other embodiments, one or more, but not all, shroud segments comprise a retainer ring segment. Each retainer ring segment 90 and 92 is spaced from end 94 of shroud segment 16 and shroud segment 26, respectively. In one embodiment, the distance 96 of ring segments 90 and 92 from end 94 is determined in relation to location of end 98 of jumper connector 52, which is determined when jumper connector 52 is in an installed position and connected to shunt tube 44 (see FIG. 5). In one embodiment, retainer ring 22 is sized to be closely positioned to end 98 of jumper connector 52 after installation of jumper tube 50 with jumper connector 52 fluidly connecting jumper tube 50 with shunt tube 44.

As retainer ring segments 90 and 92 are in a fixed axial position upon installation of shroud segments 16 and 26, in one embodiment, retainer ring 22, or retainer ring segment 90 or 92, limits axial movement of connector 52 in the direction away from collar 14, thereby preventing disengagement of connector 52 from shunt tube 44 without necessity of attaching connector 52 to jumper tube 50 or shunt tube 44 by screws or other fastening mechanism. In exemplary embodiments, each shroud 12 comprises one or more retainer ring segments proximate each end thereof, at one end limiting axial movement of the proximal jumper connector 52 (shown in FIG. 5), and at the other end limiting axial move movement of a distal jumper connector 52 (not shown). In one embodiment, the distal retainer ring segment (s) is/are disposed in shroud 12 such that axial movement of the distal jumper connector 52 is limited at the end thereof which is disposed nearest to end 98 of proximal jumper connector 52. As is known in the art, additional device features (not shown) may be employed to limit axial movement of connectors 52 in the direction toward collars 14. In one embodiment, shroud 12 may comprise additional retainer rings segments, such that, for example, both ends 98 and 99 of each jumper connector 52 are axially limited in movement, each by retainer rings or retainer ring segments.

In one embodiment, for fluid connection of a first shunt tube 44 to a corresponding second shunt tube 44 on a connected pipe segment, a jumper tube 50 is placed partially within, and is enclosed by, a first end of a first connector 52, and at least partially within, and enclosed by, a first end of a second connector 52. Although the tubing connectivity described in this embodiment employs enclosure of jumper tube 50 within connector 52, the invention is not so limited, and additional embodiments may comprise other fluid connections there between. This combination is axially aligned with the shunt tubes, such that a second end of first connector 52 is disposed proximate an end of the first shunt tube 44, and a second end of second connector 52 is disposed proximate an end of the second shunt tube 44. First connector 52 is then slid onto the end of first shunt tube 44 such that first connector 52 encloses that end of that shunt tube 44, and second connector 52 is slid onto the end of second shunt tube 44 such that second connector 52 encloses that end of that shunt tube 44. Although the tubing connectivity described in this embodiment employs enclosure of shunt tube 44 within connector 52, the invention is not so limited, and additional embodiments may comprise other fluid connections there between. The steps of connecting first tube connector 52 to first shunt tube 44 and connecting second tube connector 52 to second shunt tube 44 may performed sequentially or concurrently. As connectors 52 are provided with ring seals 102 (FIG. 8), the connectors 52 will retain such position until a shroud segment 16 or 26 is provided, thereby providing one or more retainer ring segments 90 or 92 under one or more ends 98 of one or more of the connectors 52.

In one embodiment, fluid connection of a first shunt tube 44 of a first pipe segment to a corresponding second shunt tube 44 of a connected second pipe segment comprises sliding a first end of a connector 52 onto an end of the first shunt tube 44 when the pipe segments are unconnected, such that connector 52 encloses the end, and a portion of the length, of the first shunt tube 44. The pipe segments are then connected such that a second end of the connector 52 is axially aligned with and disposed proximate an end of the second shunt tube. Then, the connector 52 is slid partially off the first shunt tube 44, thereby sliding the second end of the connector 52 onto and enclosing the end of the second shunt tube.

In exemplary practice, an embodiment of an end ring 14 is positioned on each of two pipe segments to be connected, proximate the ends thereof which are to be connected. The end rings 14 are then fixedly attached to the pipe segment, such as by welding. Upon connection of the pipe segments, such as by pipe joint 48, end rings 14 on the respective connected pipe segments are disposed appropriately for shrouding with jumper shroud 12, after installation of a jumper tube 50 and two connectors 52 on each axially aligned pair of shunt tubes 44. The teachings of embodiments of the present invention have been described as to fluid connection of one end of jumper tube 50 to a shunt tube 44 of one pipe segment 40, via a tube connector 52, and to connection of shroud segments 16 and 26 to a collar 14. In like manner, the distal end of jumper tube 50 can be fluidly connected to a corresponding shunt tube 44 of the second pipe segment, via a tube connector 52. In one embodiment, the distal ends of shroud segments 16 and 26 can be connected to a collar 14 of a second pipe 40 segment connected at a joint 48 (FIG. 6), using a similar dove pin/dove tail arrangement as described herein. It is noted that a spring lock 18, though practicable at the distal end, is not required for the distal connection.

In additional embodiments of the present invention, various embodiments of collar 14 may be employed. In one embodiment, a collar 14 positioned on one of the pipe segments does not contain a dove tail 30. In such an embodiment, that collar 14 may comprise a connection mechanism other than a dove pin/dove arrangement for attachment of one end of shrouds 16 and 26 thereto, or it may comprise no connection mechanism. In various embodiments, collar 14 may comprise one or more components (or combinations of components) discontinuously disposed around, and fixedly attached to, the exterior of a pipe segment, rather than an annular unit. In one embodiment, only one pipe segment is provided with a collar 14.

Figure 9:
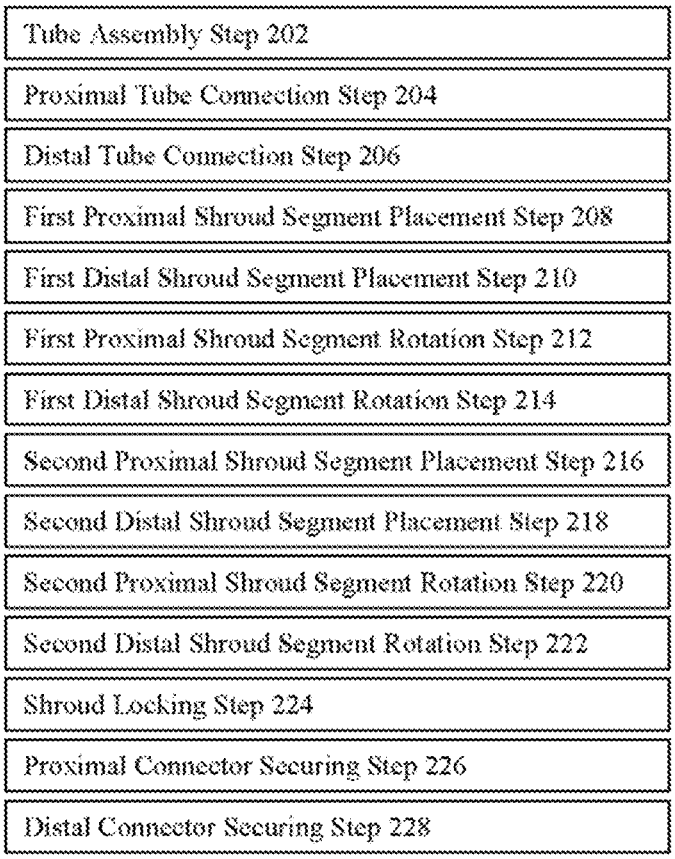
FIG. 9 depicts an embodiment of a method of the present invention.

FIG. 9 depicts an exemplary method 200 for utilizing an embodiment of a connector system of the present invention comprising the following steps:

Tube Assembly Step 202 comprises connecting a proximal end of a jumper tube, such as jumper tube 50, to a distal end of a proximal tube connector, such as tube connector 52, and connecting a distal end of the jumper tube to a proximal end of a distal tube connector, such as tube connector 52. The jumper tube is slid partially within the proximal tube connector, and is slid partially within the distal tube connector, thereby providing a tube assembly, which may be axially aligned with and disposed between the ends of a proximal shunt tube and a distal shunt tube.

Proximal Tube Connection Step 204 comprises connecting the proximal tube connector, to a proximal shunt tube, such as shunt tube 44, by sliding the proximal tube connector partially off the proximal end of the jumper tube to cover the end of the proximal shunt tube.

Distal Tube Connection Step 206 comprises connecting the distal tube connector to a distal shunt tube, such as shunt tube 44, by sliding the distal tube connector partially off the distal end of the jumper tube to cover the end of the distal shunt tube. Step 206 may be practiced prior to Step 204.

First Proximal Shroud Segment Placement Step 208 comprises placing a proximal end of a first shroud segment, such as shroud segment 16 or shroud segment 26, into engagement with a proximal collar, such as collar 14, with a first proximal dove pin, such as dove pin 20, extending into a proximal collar external surface opening, such as opening 62.

First Distal Shroud Segment Placement Step 210 comprises placing the distal end of the first shroud segment into engagement with a distal collar, such as collar 14, with a first distal dove pin, such as dove pin 20, extending into a distal collar external surface opening, such as opening 62. Step 210 may be practiced concurrently with Step 208.

First Proximal Shroud Segment Rotation Step 212 comprises rotating the first shroud segment such that the first proximal dove pin engages a proximal dove tail, such as dove tail 30, in the proximal collar.

First Distal Shroud Segment Rotation Step 214 comprises rotating the first placed shroud segment such that the first distal dove pin engages a distal dove tail, such as dove tail 30, in the distal collar. Step 214 may be practiced concurrently with Step 212.

Second Proximal Shroud Segment Placement Step 216 comprises placing a proximal end of a second shroud segment, such as shroud segment 16 or shroud segment 26, into engagement with the proximal collar with a second proximal dove pin, such as dove pin 20, extending into the proximal collar external surface opening.

Second Distal Shroud Segment Placement Step 218 comprises placing the distal end of the second shroud segment into engagement with the distal collar with a second distal dove pin, such as dove pin 20, extending into the distal collar external surface opening. Step 218 may be practiced concurrently with Step 216.

Second Proximal Shroud Segment Rotation Step 220 comprises rotating the second shroud segment such that the second proximal dove pin engages the proximal dove tail.

Second Distal Shroud Segment Rotation Step 222 comprises rotating the second shroud segment such that the second distal dove pin engages the distal dove tail. Step 222 may be practiced concurrently with Step 220.

Shroud Locking Step 224 comprises rotating the first shroud segment and the second shroud segment until a locking mechanism, such as spring lock 18 provided on a collar, engages a lock engagement mechanism, such as spring lock channel 24 provided on a shroud segment, thereby limiting rotational movement of said first shroud and said second shroud.

Proximal Connector Securing Step 226 comprises limiting axial movement of said proximal tube connector by means of a proximal retainer ring segment, such as retainer ring segment 90 or 92, or a retainer ring 22, provided on one or both of the first shroud segment and the second shroud segment. Step 226 may be practiced concurrently with Step 208 through Step 222.

Distal Connector Securing Step 228 comprises limiting axial movement of said distal tube connector by means of a distal retainer ring segment, such as retainer ring segment 90 or 92, or a retainer ring, such as retainer ring 22, provided on one or both of the first shroud segment and the second shroud segment. Step 228 may be practiced concurrently with Step 208 through Step 222.

Method 200 is merely exemplary, and additional embodiments of a method of utilizing a connector system of the present invention consistent with the teachings herein may be employed. For example, in one embodiment, Tube Assembly Step 202 comprises utilizing a plurality of jumper tubes to connect two axially aligned shunt tubes, wherein for a quantity of "n" jumper tubes used, a quantity of "n+1" tube connectors are employed, where "n" is a integer. In various embodiments, wherein each pipe segment includes a plurality of exterior shunt tubes, Tube Assembly Step 202 for each connectable pair of shunt tubes may employ the same or a different number of jumper tubes. In various embodiments utilizing more than two shroud segments, additional Shroud Segment Placement Steps and/or Shroud Segment Rotation Steps may be employed. In additional embodiments, one or more of Shroud Segment Placement Steps and/or Shroud Segment Rotation Steps may be modified to accommodate shrouds comprising only one dove pin and/or no dove pins, and/or accommodate the utilization other collar embodiments or the provision of only one collar.

In one embodiment of a method of utilizing a connector system of the present invention, two unconnected pipe segments, each equipped with one or more exterior shunt tubes, are axially aligned, whereupon a tube connector, such as tube connector 52, is slid over the end of a shunt tube, such as shunt tube 44, of the first pipe segment, enclosing the end and at least a portion of the length thereof. The pipe segments are then connected, whereupon, concurrently, the tube connector is partially slid off the first pipe segment shunt tube and slid over the end of a shunt tube, such as shunt tube 44, of the second pipe segment. A plurality of shroud segments, such as shroud segment 16 or shroud segment 26, are installed consistently with the teachings provided herein.

While the preferred embodiments of the invention have been described and illustrated, modifications thereof can be made by one skilled in the art without departing from the teachings of the invention. Descriptions of embodiments are exemplary and not limiting. The extent and scope of the invention is set forth in the appended claims and is intended to extend to equivalents thereof. The claims are incorporated into the specification. Disclosure of existing patents, publications, and known art are incorporated herein by reference to the extent required to provide details and understanding of the disclosure herein set forth.

I claim:

1. A shroud assembly for use with connectable pipe segments equipped with one or more exterior shunt tubes, comprising:

one or more collars, each collar adapted to be fixedly attached to the exterior of one of said pipe segments, and each collar comprising one or more openings, each adapted to receive one said shunt tube of said pipe segment on which said collar is attached; and a plurality of shroud segments, wherein;

each shroud segment is adapted to be disposed around at least a portion of each said pipe segment; and at least one of said shroud segments comprises at least one dove pin protruding from an inner surface thereof, wherein at least one said dove pin is adapted to be provided at least partially within and engage a dove tail provided in, and open to an exterior surface of, one said collar.

2. The shroud assembly of claim 1, wherein at least one shroud segment comprises a spring lock receptor adapted to engage a spring lock provided in one said collar.

3. The shroud assembly of claim 1, wherein at least one said shroud segment comprises on its inner surface one or more retaining protrusions adapted to abut an end of a shunt tube connection tubular.

4. The shroud assembly of claim 1, comprising a first collar fixedly attached to the exterior of a first pipe segment, and a second collar fixedly attached to the exterior of a second pipe segment.

5. The shroud assembly of claim 4, wherein:

at least one said shroud segment comprises a first said dove pin adapted to be provided at least partially within and engage a dove tail provided in, and open to an exterior surface of, said first collar; and at least one said shroud segment comprises a second said dove pin adapted to be provided at least partially within and engage a dove tail provided in, and open to an exterior surface of, said second collar.

6. The shroud assembly of claim 4, wherein at least one said collar is substantially annular.

7. A shunt tube connector assembly for use with connectable pipe segments equipped with one or more exterior shunt tubes, comprising:

at least one tube connector adapted to be fluidly connected to an end of one said shunt tube of the first of said pipe segments;

at least one tube connector adapted to be fluidly connected to an end of one said shunt tube of the second of said pipe segments;

one or more collars, each collar adapted to be fixedly attached to the exterior of one of said pipe segments, and each collar comprising one or more openings, each adapted to receive one said shunt tube of said pipe segment on which said collar is attached; and a shroud assembly comprising:

a plurality of shroud segments, wherein;

each shroud segment is adapted to be disposed around at least a portion of each said pipe segment; and at least one of said shroud segments comprises at least one dove pin protruding from an inner surface thereof, wherein at least one said dove pin is adapted to be provided at least partially within and engage a dove tail provide in, and open to an exterior surface of, one said collar.

8. The shunt tube connector assembly of claim 7, wherein the at least one tube connector adapted to be fluidly connected to an end of one said shunt tube of the first of said pipe segments and the at least one tube connector adapted to be fluidly connected to an end of one said shunt tube of the second of said pipe segments comprise the same tube connector.

9. The shunt tube connector assembly of claim 7, comprising:

at least one jumper tube; wherein each said jumper tube is adapted to be fluidly connected to two said tube connectors.

10. The shunt tube connector assembly of claim 7, wherein at least one said tube connector comprises at least one ring seal.

11. The shunt tube connector assembly of claim 7, wherein at least one said shroud segment comprises a spring lock receptor adapted to engage a spring lock provided in one said collar.

12. The shunt tube connector assembly of claim 7, wherein at least one said shroud segment comprises on its inner surface one or more retaining protrusions adapted to abut an end of one said tube connector.

13. A method for fluidly connecting and shrouding one or more connectable pipe segment exterior shunt tubes, comprising:

providing a first pipe segment axially aligned with and fluidly connected to a second pipe segment, wherein exteriorly affixed to at least one of said pipe segments, proximate a position where said pipe segments are fluidly connected, is a collar comprising a dove tail open to an exterior surface thereof;

fluidly connecting at least one exterior shunt tube of said first pipe segment to an exterior shunt tube of said second pipe segment; and attaching a plurality of shroud segments around at least a portion of each said pipe segment; wherein said attaching comprises providing at least one dove pin protruding from an inner surface of one of said shroud segments to one said dove tail and engaging said dove pin with said one said dovetail.

14. The method of claim 13, wherein said engaging said dove pin with said one said dovetail comprises rotating said shroud segments.

15. The method of claim 13, wherein said fluidly connecting at least one exterior shunt tube of said first pipe segment to an exterior shunt tube of said second pipe segment comprises:

fluidly connecting an end of a first shunt tube disposed exterior to said first pipe segment to a first end of a first tube connector;

fluidly connecting a second end of said first tube connector to a first end of a jumper tube;

fluidly connecting a second end of said jumper tube to a first end of a second tube connector; and fluidly connecting a second end of said second tube connector to an end of a second shunt tube disposed exterior to said second pipe segment.

16. The method of claim 13, wherein at least one said shroud segment comprises a spring lock receptor adapted to engage a spring lock provided in one said collar.

17. The method of claim 13, wherein:

a first collar is fixedly attached to the exterior of said first pipe segment, and a second collar is fixedly attached to the exterior of said second pipe segment.

18. The method of claim 17, wherein said attaching comprises:

providing a first said dove pin of one said shroud segment to one said dove tail of said first collar and engaging said first dove pin therewith; and providing a second said dove pin of one said shroud segment to one said dove tail of said second collar and engaging said second dove pin therewith.

19. The method of claim 13, wherein at least one said shroud segment comprises on its inner surface one or more retaining protrusions adapted to abut an end of one of one or more tubulars fluidly connecting said at least one exterior shunt tube of said first pipe segment to said exterior shunt tube of said second pipe segment.

20. The method of claim 13, wherein:

prior to connection of said first pipe segment to said second pipe segment, at least one of one or more tube connecters is fluidly attached at a first end thereof to one of said exterior shunt tubes;

said first pipe segment is subsequently connected to said second pipe segment; and subsequent to connection of said first pipe segment to said second pipe segment, said fluidly attached tube connector is fluidly connected at a second end thereof to an exterior shunt tube of said second pipe segment.

* * * * *